US007018183B2

(12) United States Patent
Haller et al.

(10) Patent No.: US 7,018,183 B2
(45) Date of Patent: Mar. 28, 2006

(54) COMPRESSOR HAVING DISCHARGE VALVE

(75) Inventors: David K. Haller, Adrian, MI (US); Robin G. Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 91 days.

(21) Appl. No.: 10/657,637

(22) Filed: Sep. 8, 2003

(65) Prior Publication Data

US 2004/0057843 A1 Mar. 25, 2004

Related U.S. Application Data

(60) Provisional application No. 60/412,905, filed on Sep. 23, 2002.

(51) Int. Cl.
*F04C 1/02* (2006.01)

(52) U.S. Cl. ..... 418/55.1; 418/55.4; 418/55.6; 418/270; 137/856

(58) Field of Classification Search ..... 418/55.1–55.5, 418/270, DIG. 1; 137/856
See application file for complete search history.

(56) References Cited

U.S. PATENT DOCUMENTS

| | | | |
|---|---|---|---|
| 2,661,172 | A | 12/1953 | Needham |
| 3,039,725 | A | 6/1962 | Kerley, Jr. |
| RE25,569 | E | 5/1964 | Coron et al. |
| 3,145,960 | A | 8/1964 | Langdon |
| 3,749,340 | A | 7/1973 | Williams et al. |
| 3,785,167 | A | 1/1974 | Sahs |
| 4,089,613 | A | 5/1978 | Babbitt, Jr. |
| 4,244,680 | A | 1/1981 | Ishizuka et al. |
| 4,389,171 | A | 6/1983 | Eber et al. |
| 4,416,594 | A | 11/1983 | Ichikawa |
| 4,497,615 | A | 2/1985 | Griffith |
| 4,518,276 | A | 5/1985 | Mitchell et al. |
| 4,552,518 | A | 11/1985 | Utter |
| 4,557,677 | A | 12/1985 | Hasegawa |
| 4,685,188 | A | 8/1987 | Goy |
| 4,767,293 | A | 8/1988 | Caillat et al. |
| 4,792,288 | A | 12/1988 | Gromoll et al. |
| 4,818,198 | A | 4/1989 | Tamura et al. |
| 4,877,382 | A | 10/1989 | Caillat et al. |

(Continued)

FOREIGN PATENT DOCUMENTS

| | | | |
|---|---|---|---|
| FR | 2 755 477 | A1 | 11/1997 |

(Continued)

OTHER PUBLICATIONS

Search Report dated May 3, 2004.

*Primary Examiner*—Theresa Trieu
(74) *Attorney, Agent, or Firm*—Baker & Daniels

(57) ABSTRACT

A compressor having a discharge valve. The discharge valve is mounted to the fixed scroll of a scroll compressor using a C-shaped clamp. The clamp is secured using a threaded fastener which extends through the clamp at a position between the two legs of the clamp. The valve member is positioned within a recess on the scroll member and sealingly covers a discharge outlet through which compressed refrigerant is discharged from the working space of the compressor. The thickness of the scroll member at the location of the discharge outlet is less than the thickness of the scroll member at the location where the threaded fastener attached the clamp to the scroll member. The valve member is larger than the discharge outlet and the recess is dimensioned to limit the movement of the valve member such that it remains positioned over the discharge outlet.

17 Claims, 7 Drawing Sheets

U.S. PATENT DOCUMENTS 4,992,033 A 2/1991 Caillat et al.
5,012,896 A 5/1991 Da Costa
5,055,010 A 10/1991 Logan
5,062,779 A 11/1991 Da Costa
5,110,268 A 5/1992 Sakurai et al.
5,114,322 A 5/1992 Caillat et al.
5,137,437 A 8/1992 Machida et al.
5,176,506 A 1/1993 Siebel
5,211,031 A 5/1993 Murayama et al.
RE34,297 E 6/1993 Elson
5,219,281 A 6/1993 Caillat et al.
5,222,885 A 6/1993 Cooksey
5,224,845 A 7/1993 Mangyo et al.
5,240,391 A 8/1993 Ramshankar et al.
5,247,738 A 9/1993 Yoshii
5,312,234 A 5/1994 Yoshii
5,345,785 A 9/1994 Sekigami et al.
5,345,970 A 9/1994 Leyderman et al.
5,346,375 A 9/1994 Akiyama et al.
5,348,455 A 9/1994 Herrick et al.
5,370,156 A 12/1994 Peracchio et al.
5,391,066 A 2/1995 Sawai et al.
5,427,511 A 6/1995 Caillat et al.
5,474,433 A 12/1995 Chang et al.
5,487,648 A 1/1996 Alfano et al.
5,522,715 A 6/1996 Watanabe et al.
5,531,577 A 7/1996 Hayase et al.
5,533,875 A 7/1996 Crum et al.
5,577,901 A * 11/1996 Yoon ..... 137/856
5,579,651 A 12/1996 Sugiyama et al.
5,580,233 A 12/1996 Wakana et al.
5,597,293 A 1/1997 Bushnell et al.
5,597,296 A 1/1997 Akazawa et al.
5,634,781 A 6/1997 Yoshida et al.
5,645,408 A 7/1997 Fujio et al.
5,660,539 A 8/1997 Matsunaga et al.
5,676,533 A * 10/1997 Park et al. ..... 137/857
5,683,237 A 11/1997 Hagiwara et al.
5,695,326 A 12/1997 Oka et al.
5,716,202 A 2/1998 Koyama et al.
5,720,601 A 2/1998 Tark et al.
5,745,992 A 5/1998 Caillat et al.
5,752,688 A 5/1998 Campbell et al.
5,769,126 A 6/1998 Cho
5,772,411 A 6/1998 Crum et al.
5,772,416 A 6/1998 Caillat et al.
5,775,894 A 7/1998 Kosco, Jr.
5,810,572 A 9/1998 Yamamoto et al.
5,829,959 A 11/1998 Tsubono et al.
5,863,190 A 1/1999 Yamamoto et al.
5,913,892 A 6/1999 Kwon
5,931,649 A 8/1999 Caillat et al.
5,931,650 A 8/1999 Yasu et al.
5,947,709 A 9/1999 Koyama et al.
5,964,581 A 10/1999 Iizuka et al.
6,000,917 A 12/1999 Smerud et al.
6,011,336 A 1/2000 Mathis et al.
6,012,489 A * 1/2000 Rene et al. ..... 137/856
6,027,321 A 2/2000 Shim et al.
6,039,551 A 3/2000 Takeuchi et al.
6,050,794 A 4/2000 Noboru et al.
6,056,523 A 5/2000 Won et al.
6,106,254 A 8/2000 Hirooka et al.
6,132,191 A 10/2000 Hugenroth et al.
6,139,291 A 10/2000 Perevozchikov
6,156,106 A 12/2000 Kamata
6,162,035 A 12/2000 Hayano et al.
6,167,719 B1 1/2001 Yakumaru et al.
6,171,076 B1 1/2001 Yakumaru et al.
6,179,589 B1 1/2001 Bass et al.
6,186,753 B1 2/2001 Hugenroth et al.
6,224,356 B1 5/2001 Dewar et al.
6,227,830 B1 5/2001 Fields et al.
6,247,910 B1 6/2001 Yokoyama
6,264,446 B1 7/2001 Rajendran et al.
6,280,154 B1 8/2001 Clendenin et al.
6,299,423 B1 10/2001 Perevozchikov
6,305,912 B1 10/2001 Svendsen et al.
6,314,990 B1 * 11/2001 Brabek et al. ..... 137/856
6,402,485 B1 6/2002 Hong et al.
6,261,073 B1 7/2003 Kumazawa
2001/0006603 A1 7/2001 Hong et al.
2001/0055536 A1 12/2001 Bernardi et al.

FOREIGN PATENT DOCUMENTS

JP 61087994 5/1986
JP 402061382 A 3/1990
JP 03255280 A * 11/1991
JP 05-288171 A 11/1993
JP 407259764 A 10/1995
JP 410148191 A 6/1998
JP 10231783 A * 9/1998
JP 2000329083 A * 11/2000
JP 2001020881 A 1/2001
JP 2001-271752 A 10/2001
JP 2002021729 A 1/2002
JP 2002098056 A 4/2002

* cited by examiner

COMPRESSOR HAVING DISCHARGE VALVE

CROSS REFERENCE TO RELATED APPLICATIONS

This application claims priority under 35 U.S.C. 119(e) of U.S. provisional patent application Ser. No. 60/412,905 filed on Sep. 23, 2002 entitled COMPRESSOR HAVING DISCHARGE VALVE the disclosure of which is hereby incorporated herein by reference.

BACKGROUND OF THE INVENTION

1. Field of the Invention

The present invention relates to compressors and, more particularly, a discharge valve for a compressor.

2. Description of the Related Art

Numerous discharge valves for controlling the discharge of a compressed gas from the working chamber of a compressor are known in the art. Oftentimes such discharge valves will include an elongate flexible valve member covering a discharge port wherein the valve member is secured by a threaded fastener located at an end of the valve member opposite the discharge port. While such valves are effective, an improved valve is desirable.

SUMMARY OF THE INVENTION

The present invention provides an improved discharge valve for a compressor which may include a clamping member to secure a flexible valve member. The clamping member may have a generally C-shaped configuration and is attached with a fastener extending through the clamp in a position intermediate the two legs of the clamp to thereby assure the clamp firmly engages the valve member. The valve member may be positioned within a narrow recess which limits the lateral movement of the valve member and thereby maintains the valve member in a position over the discharge port. A valve retainer may be positioned adjacent to the valve member to limit the movement of the valve member. The clamp used to secure the discharge valve is configured to allow the valve to be attached to the fixed scroll of a scroll compressor wherein the fastener used to secure the clamp is attached to the fixed scroll at a location which has a greater thickness than the discharge port.

The invention comprises, in one form thereof, a compressor assembly having a compressor mechanism which defines a working space for compressing a gas. A discharge chamber is disposed within the compressor assembly. A barrier element separates the working space from the discharge chamber and a discharge passage extends through the barrier element. The discharge passage has an inlet opening in gaseous communication with the working space and an outlet opening in gaseous communication with the discharge chamber. A recess is defined by the barrier element and includes first and second portions. The barrier element has a first thickness at the first portion and a second thickness at the second portion wherein the second thickness is greater than the first thickness. The outlet opening is disposed in the first portion of the recess. A substantially planar flexible valve member is disposed within the recess and is sealingly engageable with the outlet opening. A clamping member secures the valve member to the barrier element in the first portion of the recess. The clamping member is secured to the barrier element in the second portion of the recess.

The clamping member may have first and second bearing surfaces and a central span portion disposed therebetween wherein the first bearing surface is engaged with the barrier element in the second portion of the recess, the second bearing surface is engaged with the valve member and the central span portion is spaced from the barrier element. A fastener engaging the central span portion of the clamping member may be used to secure the clamping member to the barrier element.

The invention comprises, in another form thereof, a compressor assembly including a compressor mechanism defining a working space for compressing a gas. A discharge chamber is disposed within the compressor assembly and a barrier element separates the working space from the discharge chamber. A discharge passage extends through the barrier element and has an inlet opening in gaseous communication with the working space and an outlet opening in gaseous communication with the discharge chamber. The barrier element defines a first thickness at the inlet and outlet openings. A recess is also defined by the barrier element and the outlet opening is disposed in the recess. A substantially planar flexible valve member is sealingly engageable with the outlet opening. The assembly also includes a clamping member having first and second bearing surfaces and a central span portion disposed therebetween. The first bearing surface is engaged with the barrier element, the second bearing surface secures the valve member against the barrier element, and the central span portion is spaced from the barrier element. A fastener secures the clamping member to the barrier element. The fastener engages the clamping member at the central span portion and engages the barrier member at a location wherein the barrier element has a second thickness that is greater than the first thickness.

In alternative embodiments of the compressor assemblies described above, the compressor mechanism may include mutually engaged first and second scroll members wherein each of the scroll members has a base plate and a spiral wrap extending therefrom and the barrier element is defined by one of the base plates. Additionally, the valve member may have a length and a width wherein the length is substantially greater than the width and the width of the valve member is greater than a corresponding dimension of the outlet opening. Such a valve member may have a lengthwise axis wherein the clamping member engages the valve member proximate a first axial end of the valve member and the valve member is sealingly engageable with the outlet opening proximate a second axial end of the valve member. The recess includes sidewalls limiting movement of the valve member perpendicular to the lengthwise axis wherein the valve member remains sealingly engageable with the outlet opening when the valve member is displaced perpendicular to the lengthwise axis and engaged with one of the sidewalls.

The invention comprises, in yet another form thereof, a scroll compressor. The compressor includes a first scroll member having a first base plate with a front face and an opposite rear face and a first set of wraps extending from the front face of the first base plate and a second scroll member having a second base plate and a second set of wraps extending from the second base plate. The first and second scroll members are positioned with the first and second set of wraps in mutual engagement. The first and second scroll members are relatively moveably engaged wherein relative movement of the scroll members compresses a gas in a working space defined by and disposed between said first and second scroll members. A discharge chamber is disposed within the compressor. A discharge passage having an inlet opening in the front face in gaseous communication with the working space and an outlet opening in the rear face in gaseous communication with the discharge chamber extends through the first base plate at a first location wherein the first base plate has a first thickness. A recess is defined by the rear face of the first base plate and the outlet opening is disposed within the recess. A substantially planar flexible valve member is disposed within the recess and is sealingly engageable with the outlet opening. A clamping member is disposed within the recess and has first and second bearing surfaces and a central span portion disposed therebetween. The first bearing surface is engaged with the rear face, the second bearing surface secures the flexible valve member against the rear face and the central span portion is spaced from the rear face. The clamping member is attached to the first base plate at a second location wherein the first base plate has a second thickness greater than the first thickness.

The clamping member may be a substantially C-shaped member attached to the first base plate by a fastener extending through an aperture in the central span portion and engaging the first base plate at the second location. A valve retaining member may also be provided wherein the valve retaining member is disposed adjacent the valve member and limits movement of the valve member away from the outlet opening.

The valve member may include an opening and be used with a clamp having a recess with an integral projection therein. The valve member is partially disposed within the recess and the projection is disposed within the opening in the valve member to thereby secure the valve member and clamp together. When a clamp having a recess is used and the valve member is at least partially disposed in the recess, a retaining member may be positioned at least partially in the recess adjacent the valve member and limit movement of the valve member away from the outlet opening. The clamp may directly engage such a retaining member with the retaining member being directly engaged with the valve member.

The scroll compressor may have an outlet opening with a generally circular configuration and wherein the valve member has a width and a length with the length being substantially greater than the width, the width of the valve member at the outlet opening being greater than the diameter of the outlet opening.

An advantage of the present invention is that by using a clamp to secure the discharge valve to a scroll member wherein the clamp is attached with a fastener at a location where the scroll member has a thickness which is greater than that thickness of the scroll member at the discharge outlet, the volume of the discharge passage extending through the thickness of the scroll member can be reduced which provides for a greater compressor efficiency.

Another advantage of the present invention is that when a clamp having two bearing surfaces and a central span portion disposed therebetween is used, such as a generally C-shaped clamp, the clamp may be used to firmly secure the valve member in place without requiring the clamp to be manufactured to tight tolerances.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
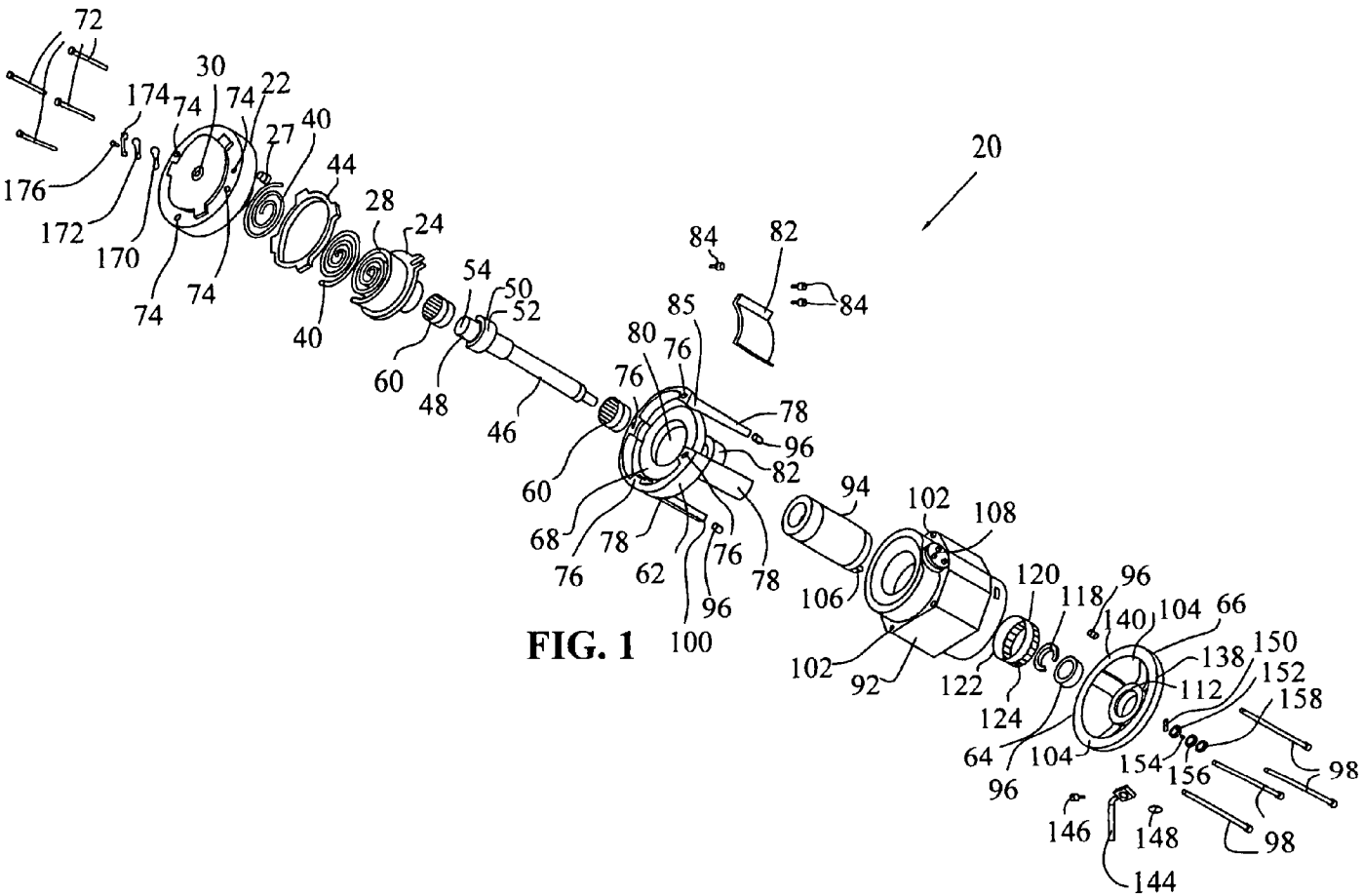
FIG. 1 is an exploded view of a scroll compressor in accordance with the present invention.
Figure 2:
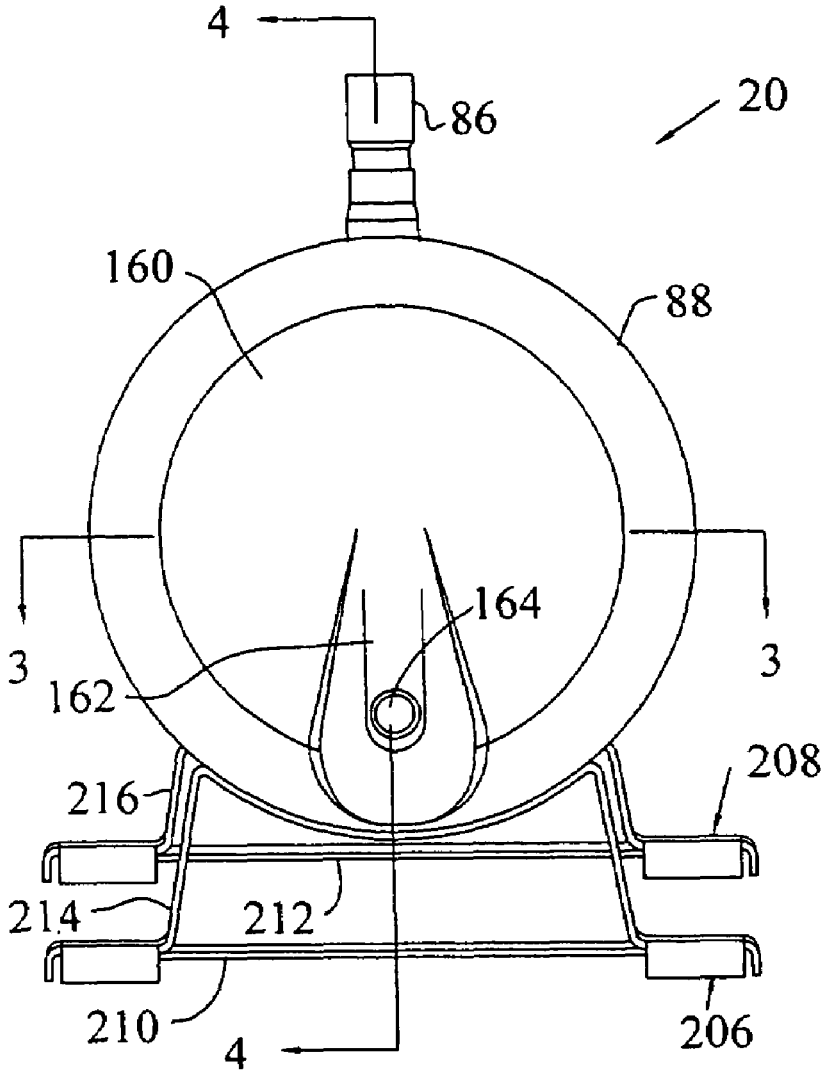
FIG. 2 is an end view of the compressor of FIG. 1.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, a scroll compressor 20 is shown in an exploded view in FIG. 1. Scroll compressor 20 includes a fixed or stationary scroll member 22 which is engaged with an orbiting scroll member 24. Fixed and orbiting scroll members 22, 24 respectively include a spiral wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the working space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member. Pressure relief valve 27 is positioned between scroll members 22, 24 to allow discharge pressure gas to be directed into the suction pressure inlet in the event of overpressurization.

A one-way valve allows compressed refrigerant to be discharged into a discharge chamber or plenum 38 and prevents compressed refrigerant located in discharge plenum 38 from reentering discharge port 30. The valve includes a flexible valve member such as valve leaf 170 which sealingly engages fixed scroll member 22 at discharge port 30 and a valve retaining member such as valve retainer 172. Valve leaf 170 is secured between fixed scroll member 22 and valve retainer 172. Valve retainer 172 has a bend proximate its distal end which allows valve leaf 170 to flex outwardly away from discharge port 30 when gas is compressed between scroll members 22, 24 and thereby permit the passage of high pressure gas into discharge plenum 38. Valve retainer 172 limits the extent to which valve leaf 170 may flex outwardly away from discharge port 30 to prevent damage from excessive flexing of valve leaf 170. A threaded fastener 176 secures a clamp 174 which in turn secures valve retainer 172 and valve leaf 170 to fixed scroll member 22. This valve arrangement is discussed in greater detail below.

An Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension 48 on shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall 52 which eccentrically loads shaft 46 to counterbalance the eccentric loading of shaft 46 by orbiting scroll 24. Counterweight 50 is heat shrink fitted onto shaft 46 in the disclosed embodiment. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and crankcase 62. A ball bearing 64 is positioned near the opposite end of shaft 46 and is mounted within bearing support 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM and which is hereby incorporated herein by reference.

Crankcase 62 is secured to fixed scroll 22 with threaded fasteners 72 which pass through apertures 74 located in fixed scroll 22 and engage threaded bores 76 in crankcase 62. Crankcase 62 includes a thrust surface 68 which slidably engages orbiting scroll 24 and restricts movement of orbiting scroll 24 away from fixed scroll 22. Crankcase 62 also includes four legs 78 which secure the crankcase to stator 92 as described in greater detail below. Shaft 46 extends through opening 80 in crankcase 62. Crankcase 62 includes a shroud portion 70 which is disposed between legs 78 in the lower portion of the horizontal compressor housing and partially encloses a space within which counterweight 50 rotates. Shroud 70 includes an opening 81 along its upper portion which permits the equalization of pressure between the space partially enclosed by shroud 70 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

Figure 4:
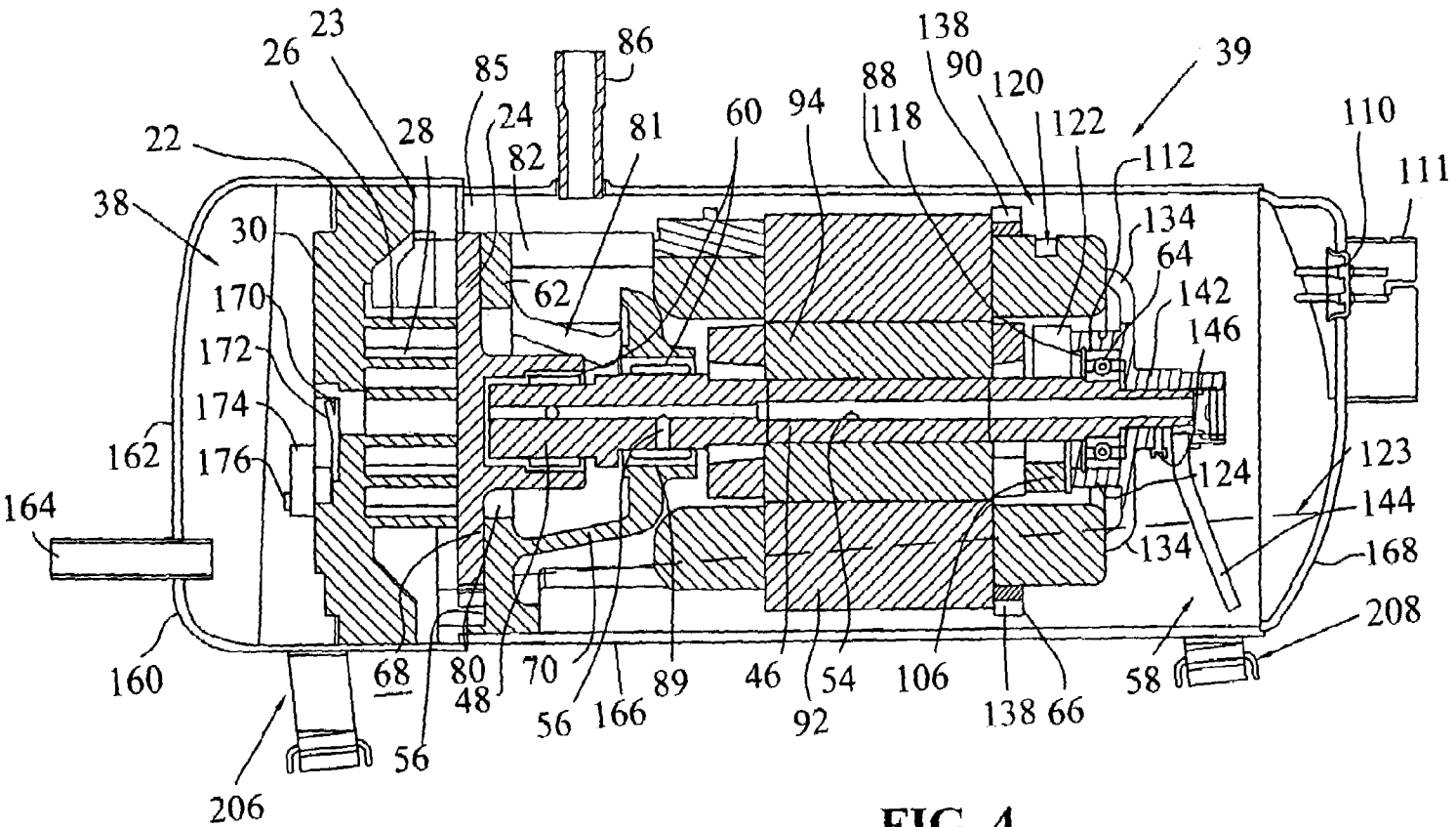
FIG. 4 is a sectional view of the compressor of FIG. 2 taken along line 4—4.

A suction baffle 82 (FIG. 1) is secured between two legs 78 using fasteners. The illustrated fasteners are socket head cap screws 84 but other fasteners such as self-tapping screws and other fastening methods may also be used to secure suction baffle 82. Suction baffle 82 is positioned proximate inlet tube 86 as best seen in FIG. 4. Refrigerant enters compressor housing 88 through inlet tube 86 and suction baffle 82 is positioned in the flow path of entering refrigerant to redirect the refrigerant along the outer perimeter of crankcase 62. The outer perimeter of crankcase 62 includes a recess 85 adjacent suction baffle 82 which defines a passage to inlet 23. Crankcase 62 includes a sleeve portion 89 in which roller bearing 60 is mounted for rotatably supporting shaft 46. Sleeve 89 is supported by shroud portion 70 opposite opening 80. An alternative crankcase and suction baffle assembly may include an inlet to housing 88 located at mid-height wherein the suction baffle has a narrow opening located between inlet 86 and inlet 23 which extends transverse to the flow direction of refrigerant along the suction baffle to strip oil from the suction baffle. Crankcases and suction baffles which may be used with compressor 20 are described by Haller, et al. in U.S. Provisional Patent Application Ser. No. 60/412,768 entitled COMPRESSOR ASSEMBLY filed on Sep. 23, 2002 which is hereby incorporated herein by reference.

A motor 90 is disposed adjacent crankcase 62 and includes a stator 92 and a rotor 94. Bushings 96 are used to properly position stator 92 with respect to crankcase 62 and bearing support 66 when assembling compressor 20. During assembly, crankcase 62, motor 90 and bearing support 66 must have their respective bores through which shaft 46 is inserted precisely aligned. Smooth bore pilot holes 100, 102, 104 which are precisely located relative to these bores are provided in crankcase 62, motor 90 and bearing support 66. Alignment bushings 96 fit tightly within the pilot holes to properly align crankcase 62, motor 90 and bearing support 66. Bolts 98 (FIG. 1) are then used to secure bearing support 66, motor 90 and crankcase 62 together. Pilot holes 100 are located on the distal ends of legs 78 in crankcase 62 and bolts 98 are threaded into engagement with threaded portions of holes 100 when securing crankcase 62, motor 90 and bearing support 66 together. Pilot holes 102 located in stator 92 of motor 90 extend through stator 92 and allow the passage of bolts 98 therethrough. Pilot holes 104 located in bearing support 66 also allow the passage of the shafts of bolts 98 therethrough but prevent the passage of the heads of bolts 98 which bear against bearing support 66 when bolts 98 are engaged with crankcase 62 to thereby secure crankcase 62, motor 90 and bearing support 66 together. In the disclosed embodiment, bushings 96 are hollow sleeves and bolts 98 are inserted through bushings 96. Alternative embodiments, however, could employ pilot holes and bushings to properly align crankcase 62, motor 90 and bearing support 66 with different methods of securing these parts together. For example, the pilot holes could be separate from the openings through which bolts 98 are inserted or alternative methods of securing crankcase 62, motor 90 and bearing support 66 together could be employed with the use of pilot holes and alignment bushings 96. Alignment bushings which may be used with compressor 20 are described by Skinner in U.S. Provisional Patent Application Ser. No. 60/412,868 entitled COMPRESSOR HAVING ALIGNMENT BUSHINGS AND ASSEMBLY METHOD filed on Sep. 23, 2002 which is hereby incorporated herein by reference. Additional methods not utilizing pilot holes and alignment bushings may also be employed to secure crankcase 62, motor 90 and bearing support 66 together.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate bearing support 66.

As mentioned above, shaft 46 is rotatably supported by ball bearing 64 which is mounted in bearing support 66. Bearing support 66 includes a central boss 112 which defines a substantially cylindrical opening 114 in which ball bearing 64 is mounted. A retaining ring 118 is fitted within a groove 116 located in the interior of opening 114 to retain ball bearing 64 within boss 112. An oil shield 120 is secured to boss 112 and has a cylindrical portion 122 which extends towards motor 90 therefrom. Counterweight 106 is disposed within the space circumscribed by cylindrical portion 122 and is thereby shielded from the oil located in oil sump 58, although it is expected that the oil level 123 will be below oil shield 120 under most circumstances, as shown in FIG. 4. Oil shield 120 is positioned so that it inhibits the impacting of counterweight 106 on oil migrating to oil sump 58 and also inhibits the agitation of oil within oil sump 58 which might be caused by the movement of refrigerant gas created by the rotation of eccentrically positioned counterweight 106. A second substantially cylindrical portion 124 of oil shield 120 has a smaller diameter than the first cylindrical portion 122 and has a plurality of longitudinally extending tabs. Boss 112 includes a circular groove and oil shield 120 is secured to boss 112 by engaging the radially inwardly bent distal portions with the circular groove. An oil shield which may be used compressor 20 is described by Skinner in U.S. Provisional Patent Application Ser. No. 60/412,838 entitled COMPRESSOR HAVING COUNTERWEIGHT SHIELD filed on Sep. 23, 2002 which is hereby incorporated herein by reference.

Support arms 134 extend between boss 112 and outer ring 136 of bearing support 66. The outer perimeter of ring 136 is press fit into engagement with housing 88 to secure bearing support 66 therein. The interior perimeter of outer ring 136 faces the windings of stator 92 when bearing support 66 is engaged with motor 90. Flats 138 are located on the outer perimeter of ring 136 and the upper flat 138 facilitates the equalization of pressure within suction plenum 39 by allowing refrigerant to pass between outer ring 136 and housing 88. Flat 138 located along the bottom of ring 136 allows oil in oil sump 58 to pass between ring 136 and housing 88. A notch 140 located on the interior perimeter of outer ring 136 may be used to locate bearing support 66 during machining of bearing support 66 and also facilitates the equalization of pressure within suction plenum 39 by allowing refrigerant to pass between stator 92 and ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An O-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 112. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in U.S. Provisional Patent Application Ser. No. 60/412,890 entitled COMPRESSOR HAVING BEARING SUPPORT filed on Sep. 23, 2002 which is hereby incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
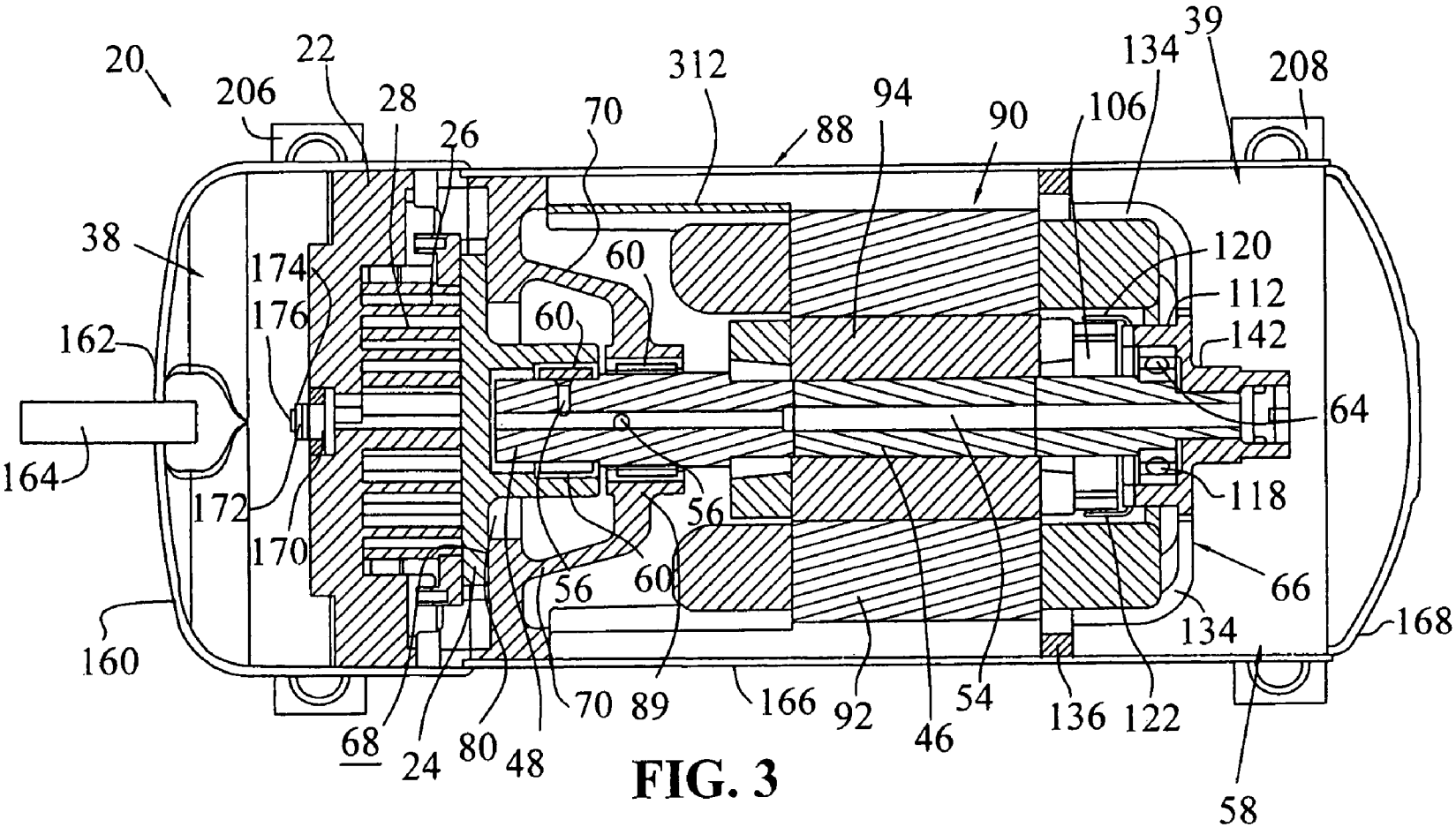
FIG. 3 is a sectional view of the compressor of FIG. 2 taken along line 3—3.

As can be seen in FIGS. 3 and 4, compressor housing 88 includes a discharge end cap 160 having a relatively flat portion 162. Housing 88 also includes a cylindrical shell 166 and rear end cap 168. End caps 160, 168 are welded to cylindrical shell 166 to provide an hermetically sealed enclosure. A discharge tube 164 extends through an opening in flat portion 162. The securement of discharge tube 164 to end cap 160 by welding or brazing is facilitated by the use of flat portion 162 immediately surrounding the opening through which discharge tube 164 is positioned.

After the compressor and motor subassembly is assembled and shrink-fitted into cylindrical housing shell 166, fixed scroll member 22 is positioned within discharge end cap 160 and tightly engages the interior surface of end cap 160. Discharge plenum 38 is formed between discharge end cap 160 and fixed scroll member 22. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 is located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Although the disclosed embodiment utilizes a short, straight length of tubing to provide discharge tube 164, alternative embodiments of the discharge outlet may also be used. A discharge plenum configuration which may be used with compressor 20 is described by Skinner in U.S. Provisional Patent Application Ser. No. 60/412,871 entitled COMPRESSOR DISCHARGE ASSEMBLY filed on Sept. 23, 2002 which is hereby incorporated herein by reference.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 by a swaging operation. The mounting brackets used with compressor 20 may be those described by Skinner in U.S. Provisional Patent Application Ser. No. 60/412,884 entitled COMPRESSOR MOUNTING BRACKET AND METHOD OF MAKING filed on Sep. 23, 2002 which is hereby incorporated herein by reference. Alternative mounting brackets may also be employed. For example, mounting brackets formed by support members similar to members 214 and 216 but which have been given greater rigidity by bending their outer edges downward along the full length of the support members may be used without a crossbrace to support compressor 20.

Figure 5:
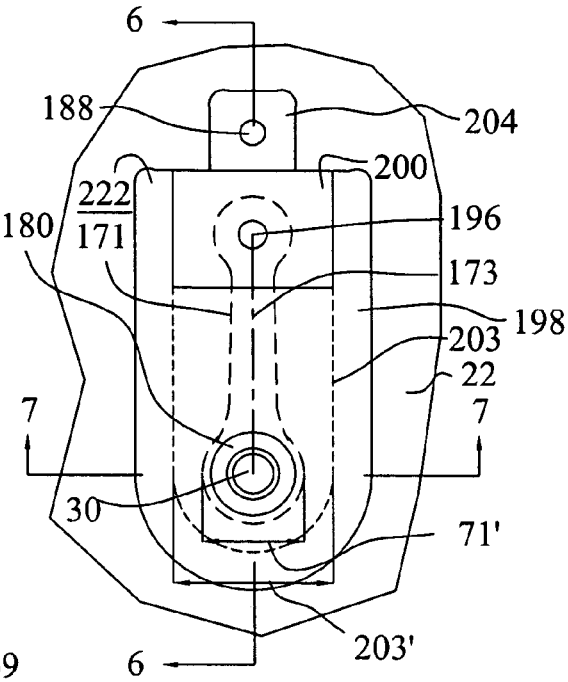
FIG. 5 is a partial plan view of a fixed scroll member and a discharge valve.
Figure 6:
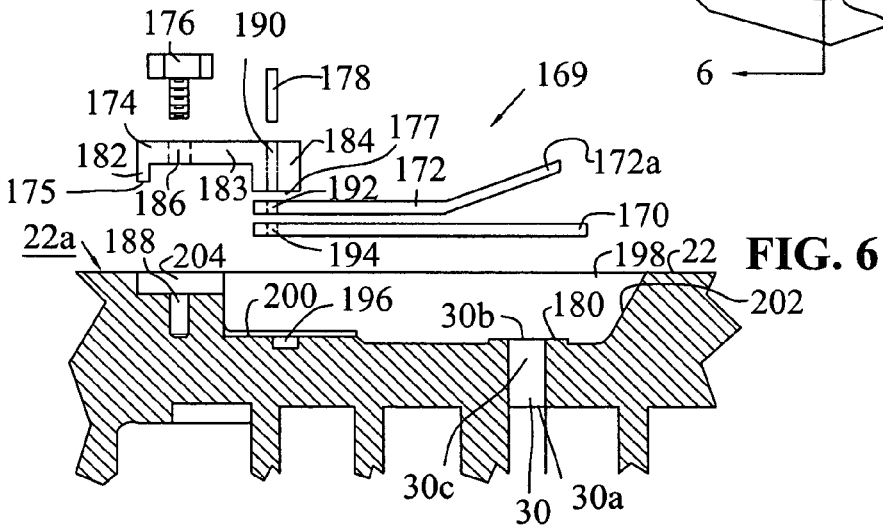
FIG. 6 is an exploded cross sectional view taken along line 6—6 of FIG. 5.
Figure 7:
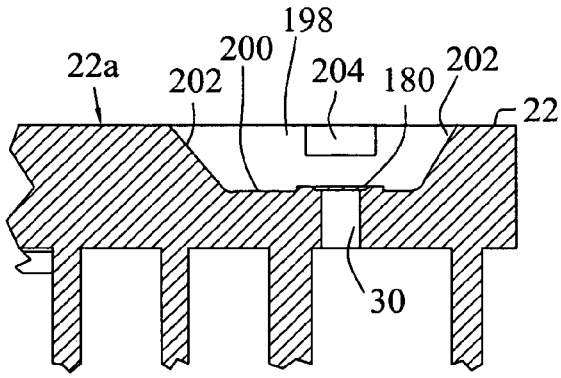
FIG. 7 is a cross sectional view taken along line 7—7 of FIG. 5.

A reed-type discharge valve assembly 169 for use with port 30 is illustrated in FIGS. 5–7. Valve assembly 169 includes a valve member 170, valve retainer 172, clamp 174, fastener 176 and pin 178 as discussed below. Valve member or leaf 170 sealingly engages annular rim 180 which surrounds and defines the outlet of discharge port 30. Valve retainer 172 is positioned adjacently above valve leaf 170 and secures valve leaf 170 against rear face 22*a* of fixed scroll 22. Valve retainer 172 secures valve leaf 170 against fixed scroll 22 where clamp 174 engages valve retainer 172. Distal end 172*a* of valve retainer is bent outwardly away from valve leaf 170 above annular rim 180 to allow valve leaf 170 to move away from annular rim 180 and permit the discharge of compressed gas or refrigerant from discharge port 30 when the refrigerant contained therein reaches a sufficiently high pressure. When valve leaf 170 is biased away from annular rim 180 by the discharge of compressed gas, distal end 172*a* of valve retainer 172 limits the extent to which valve leaf 170 may be flexed to thereby inhibit damage to valve leaf 170 by excessive flexing. Valve retainer 172 has a sufficient thickness so that it can resist the outward flexing of valve leaf 170 due to the discharge of pressurized gas from discharge port 30.

Valve leaf 170 and valve retainer 172 are secured to fixed scroll 22 with clamp 174. To secure valve retainer 172 and valve leaf 170 against rear face 22*a* of fixed scroll 22, clamp 174 directly engages valve retainer 172 while valve retainer 172 directly engages valve member 170. Clamp 174 is attached to fixed scroll 22 with threaded fastener 176 and a roll pin 178 connects clamp 174 to valve leaf 170 and valve retainer 172. Roll pin 178 also aligns valve leaf 170 and valve retainer 172 relative to each other and clamp 174. Clamp 174 has a generally C-shaped configuration with a first leg 182 and a second leg 184. Threaded fastener 176 is inserted through opening 186 to engage bore hole 188 located in fixed scroll 22. Opening 186 is positioned in central span 183 which extends between legs 182 and 184 so that as threaded fastener 176 is secured to fixed scroll 22 it biases leg 184 into firm engagement with valve retainer 172. A clamp having two points of contact, such as bearing surfaces 175 and 177 of legs 182 and 184, with a fastener, such as fastener 176, securing the clamp to fixed scroll 22 between the two points of contact, firmly secures valve retainer 172 and valve leaf 170 against rear surface 22*a* of fixed scroll 22 without requiring the clamp to be manufactured to tight tolerances. In other words, providing a gap between central span 183 of clamp 174 and fixed scroll 22 at the location of opening 186 facilitates the adequate tightening of fastener 176 and the securing of valve retainer 172 and valve leaf 170.

A second opening 190 extending through clamp 174 is located in leg 184. Pin 178 is inserted through opening 190 as well as through openings 192 and 194 located in valve retainer 172 and valve leaf 170 respectively. The lower portion of pin 178 extends into circular recess 196 located in fixed scroll 22. Pin 178 limits the lateral movement of valve retainer 172 and valve leaf 170 while leg 184 secures valve retainer 172 and valve leaf 170 against fixed scroll 22. Instead of a separate pin, clamp 174 could alternatively use an integral projection for engaging valve retainer 172 and valve leaf 170.

Discharge valve 169 is located in a recess defined by rear surface 22*a* of fixed scroll member 22. The recess is located in a barrier element separating the working space of the compressor mechanism formed by scroll members 22, 24. In the illustrated embodiments, the barrier element is formed by base plate 21 of fixed scroll member 22. The recess includes a first portion 198 in which discharge port 30 and annular rim 180 are located. An elevated portion 200 surrounds circular recess 196 and leg 184 secures valve retainer 172 and valve leaf 170 against elevated portion 200. Portion 200 is positioned to be substantially aligned with annular rim 180.

Sloping sidewalls 202 of recess portion 198 limit the extent to which valve leaf 170 and valve retainer 172 may move laterally to maintain valve members 170, 172 in position over discharge port 30. FIG. 5 illustrates the outline of valve leaf 170 with dashed outline 171. The point at which valve member 170 would impact sloping sidewalls 202 is illustrated in FIG. 5 by dashed line 203. At discharge port 30, the width between sidewalls 202 at the level of valve member 170 is 203' while the width of valve member 170 at this location is 71'. Width 71' is sufficiently greater than the diameter of discharge port 30 that if valve member 170 were to be laterally displaced and abut one of sidewalls 202, valve member 170 would still sealingly cover discharge port 30.

As can also be seen with reference to FIGS. 5 and 6, valve member 170 (shown in outline 171) has a length substantially greater than its width and the width 71' of the valve member is greater than the corresponding dimension of outlet opening 30*b*, i.e., width 71' is greater than the dimension of outlet opening 30*b* in a direction perpendicular to lengthwise axis 173 whereby width 71' is sufficient to sealingly cover outlet opening 30*b*. Clamp 174 secures a first axial end of valve member 170 at opening 194 and a second axial end of valve member 170 sealingly engages rim 180 to seal outlet opening 30*b*. As described above, the second axial end of valve member 170 is configured so that if it is displaced in a direction perpendicular to lengthwise axis 173 it will still sealingly cover outlet opening 30*b* when it engages one of the sidewalls 202.

As best seen in FIG. 6, bore 188 which receives fastener 176 is located in a second recess portion 204. The thickness of fixed scroll 22 is greater at second recess portion 204 than at first recess portion 198. Clamp leg 182 engages fixed scroll 22 in second recess portion 204 and clamp leg 182 is correspondingly shorter than clamp leg 184. Bore 188 must be placed in fixed scroll 22 at a location which has a thickness which is sufficiently great to prevent damage to fixed scroll 22 when machining bore 188 and which provides fixed scroll 22 with sufficient strength after machining bore 188 in fixed scroll 22. By placing discharge port 30 in a thinner portion of fixed scroll 22 than bore 188, the volume of discharge port 30 which extends through the thickness of fixed scroll 22 can be reduced. Reducing the volume defined by discharge port 30 improves the efficiency of compressor 20 because the volume defined by discharge port 30 is in communication with the compression pocket defined between scroll members 22, 24 immediately adjacent discharge port 30 and effectively enlarges the volumetric size of the compression pocket which is in communication with discharge port 30 by the volume of discharge port 30. The discharge port 30 defines an inlet opening 30*a* and an outlet opening 30*b* connected therebetween by discharge passage 30*c*.

Figure 8:
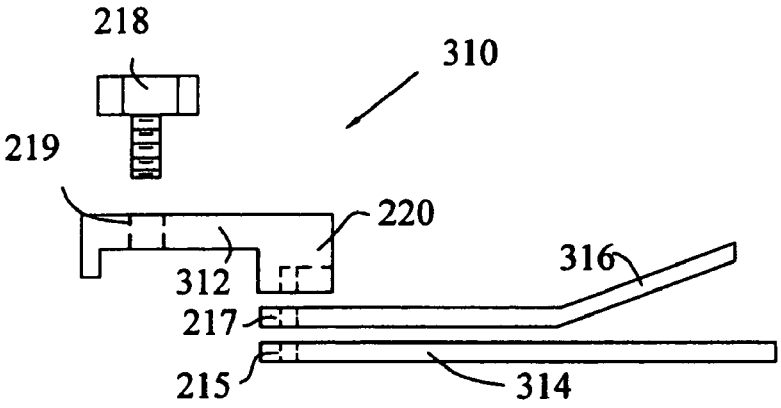
FIG. 8 is an exploded view of an alternative discharge valve assembly.
Figure 9:
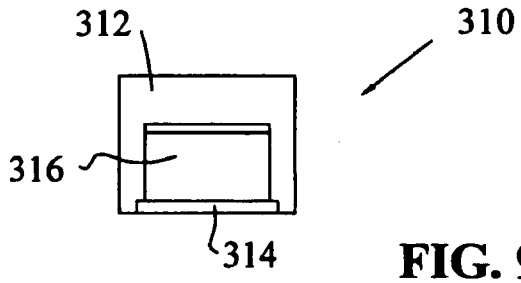
FIG. 9 is a front view of the discharge valve assembly of FIG. 8.
Figure 10:
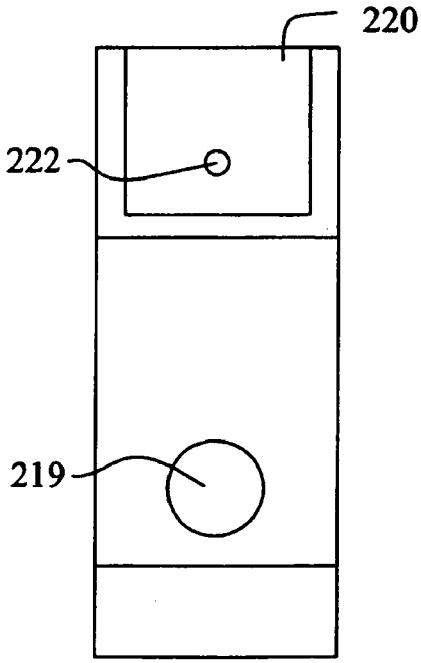
FIG. 10 is a bottom view of the clamp used in the assembly of FIG. 8.

An alternative embodiment is shown in FIGS. 8–10. Discharge valve assembly 310 includes a clamp 312 which secures valve member 314 and retaining member 316 which function similar to valve leaf 170 and valve retainer 172 respectively. A threaded fastener 218 is inserted through opening 219 to secure clamp 312 in the same manner clamp 174 is secured. Clamp 312 includes a recess 220 which receives valve member 314 and retaining member 316. By using recess 220 instead of pin 178, the rotation of valve member 314 and retaining member 316 which may lead to members 314, 316 riding up sidewalls 202 can be reduced or prevented. In addition to recess 220, clamp 312 includes an integral projection 222 located in said recess 220 for insertion in openings 215 and 217 in members 314 and 316. In an alternative embodiment, clamp 312 without a projection 222 could be used to secure valve member 314 and retaining member 316.

Figure 11:
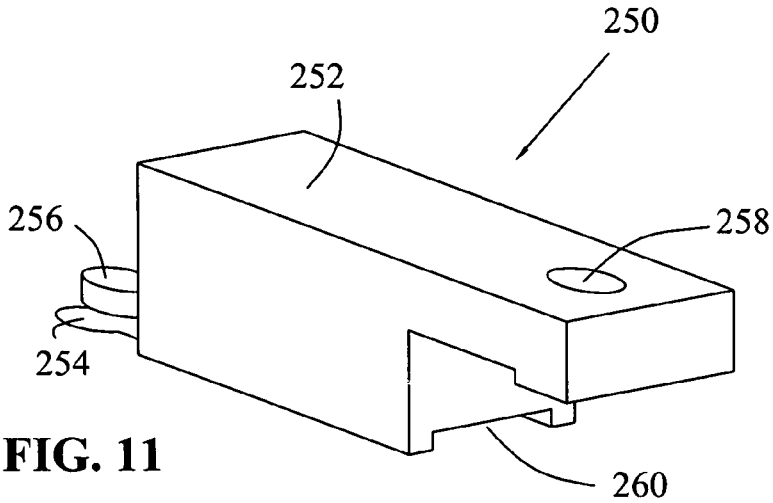
FIG. 11 is a perspective view of an additional embodiment of a discharge valve assembly.
Figure 12:
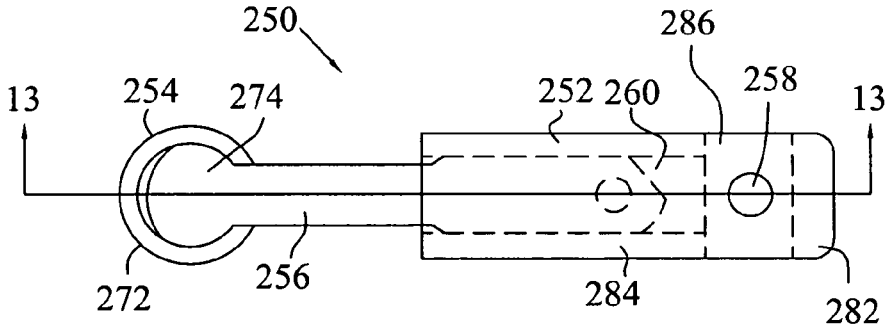
FIG. 12 is a plan view of the discharge valve assembly of FIG. 11.
Figure 13:
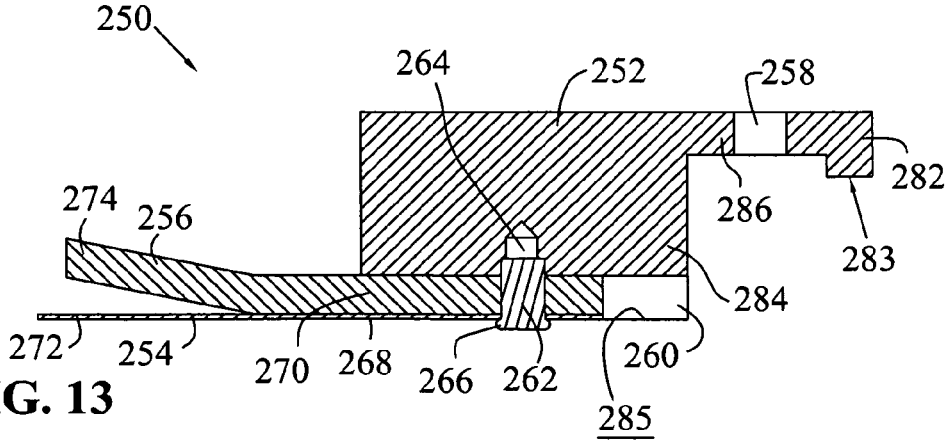
FIG. 13 is a cross sectional view taken along line 13—13 of FIG. 12.

Yet another embodiment of a discharge valve assembly is shown in FIGS. 11–13. Discharge valve assembly 250 illustrated in FIGS. 11–13 includes a clamp 252 which secures valve member 254 and retaining member 256 which function similar to valve leaf 170 and valve retainer 172 respectively. A threaded fastener (not shown) is inserted through opening 258 to secure clamp 252 to scroll member 22 in a manner similar to the manner in which clamp 174 is secured to scroll member 22. Valve assembly 250 is secured to the rear surface of a scroll member which is configured similar to scroll member 22 used with clamp assembly 169 and illustrated in FIGS. 5–7. Like clamp 312, clamp 252 includes a recess 260 on its lower surface for receiving valve member 254 and retaining member 256 and inhibiting the rotation of valve member 254 and retaining member 256. Valve member 254 and retaining member 256 each include an opening and are secured to clamp 252 with rivet 262. The shank of rivet 262 passes through the openings in valve member 254 and retaining member 256 and rivet 262 engages bore hole 264 of clamp 252. Rivet 262 includes a head 266 which secures valve member 254 and retaining member 256 to clamp 252. Rivet head 266 is positioned in circular recess 196 or a countersink recess or similar depression located on rear surface 22*a* of scroll member 22 at the location of circular recess 196 shown in FIGS. 5 and 6.

Recess 260 is generally rectangular and those portions 268, 270 of valve member 254 and valve retaining member 256, respectively, which are disposed within recess 260 generally conform to the shape of recess 260 to limit the relative movement of members 254 and 256 within recess 260. Distal end 272 of valve member 254 has a generally circular shape and larger diameter than annular rim 180 which distal end 272 is adapted to sealingly engage. Similarly, distal end 274 of retaining member 256 has a generally circular shape. As can be seen in FIG. 12, the radius of distal end 274 is smaller than that of distal end 254. As best seen in FIG. 13, retaining member 256 has a bend whereby distal end 274 is spaced from distal end 272 of valve member 254 and is positioned to limit the extent to which distal end 272 may be biased away from the outlet opening defined by rim 180 by the discharge of pressurized refrigerant.

Similar to clamp 174, clamp 252 is generally C-shaped having opposite distal ends defining a first leg 282 and a second leg 284 with a central span 286 extending therebetween with an opening 258 for a fastener. The lower surfaces 283, 285 of first and second legs 282, 284, respectively, are engaged with rear surface 22*a* of scroll member 22 when clamp 252 is secured to scroll member 22.

Clamps 174, 312 and 252 may be formed using powdered metal or by machining an extruded metal such as aluminum. Flexible valve members 170, 314 and 254 may be formed out of Swedish valve steel while valve retaining members 172, 316 and 256 may be formed out of millsteel. To provide retaining members 172, 316 and 256 with the desired rigidity, the thickness of valve retaining members 172, 316 and 256 may be significantly greater than that of flexible valve members 170, 314 and 254. The relative thickness of these parts are not necessarily shown to scale in the Figures. For example, valve members 170, 314 and 254 may have a thickness of approximately 0.012 inches (0.305 mm) while valve retaining members 172, 316 and 256 may have a thickness of approximately 0.109 inches (2.77 mm).

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a compressor mechanism, said compressor mechanism defining a working space for compressing a gas;

a discharge chamber disposed within said compressor assembly;

a barrier element separating said working space from said discharge chamber;

a discharge passage extending through said barrier element, said discharge passage having an inlet opening in gaseous communication with said working space and an outlet opening in gaseous communication with said discharge chamber;

a recess defined by said barrier element, said recess having first and second portions, said barrier element having a first thickness at said first portion and a second thickness at said second portion wherein said second thickness is greater than said first thickness, said outlet opening disposed in said first portion of said recess;

a substantially planar flexible valve member disposed within said recess and sealingly engageable with said outlet opening; and a clamping member, said clamping member defining a first leg and a second leg, said second leg disposed within said first portion and securing said valve member to said barrier element in said first portion of said recess, said first leg disposed within second portion and bearing against said barrier element in said second portion of said recess.

2. The compressor assembly of claim 1 wherein said first leg defines a first bearing surface, said second leg defines a second bearing surface, said clamping member defines a central span portion disposed between said first and second legs, said first bearing surface engaged with said barrier element in said second portion of said recess, said second bearing surface engaged with said valve member, and said central span portion being spaced from said barrier element.

3. The compressor assembly of claim 2 further comprising a fastener securing said clamping member to said barrier element, said fastener engaging said central span portion of said clamping member.

4. The compressor assembly of claim 1 wherein said compressor mechanism comprises mutually engaged first and second scroll members, each of said scroll members having a base plate and a spiral wrap extending therefrom, said barrier element being defined by one of said base plates.

5. The compressor assembly of claim 1 wherein said valve member has a length and a width, said length being substantially greater than said width, said width of said valve member being greater than a corresponding dimension of said outlet opening, said valve member having a lengthwise axis wherein said clamping member engages said valve member proximate a first axial end of said valve member, said valve member sealingly engageable with said outlet opening proximate a second axial end of said valve member; said recess including sidewalls limiting movement of said valve member perpendicular to said lengthwise axis wherein said valve member remains sealingly engageable with said outlet opening when said valve member is displaced perpendicular to said lengthwise axis and engaged with one of said sidewalls.

6. A compressor assembly comprising:

a compressor mechanism, said compressor mechanism defining a working space for compressing a gas;

a discharge chamber disposed within said compressor assembly;

a barrier element separating said working space from said discharge chamber;

a discharge passage extending through said barrier element and having an inlet opening in gaseous communication with said working space and an outlet opening in gaseous communication with said discharge chamber said barrier element defining a first thickness at said inlet and outlet openings;

a recess defined by said barrier element, said outlet opening disposed in said recess;

a substantially planar flexible valve member sealingly engageable with said outlet opening;

a clamping member having first and second bearing surfaces and a central span portion disposed therebetween, said first bearing surface engaged with said barrier element, said second bearing surface securing said valve member against said barrier element and said central span portion spaced from said barrier element; and a fastener securing said clamping member to said barrier element, said fastener engaging said clamping member at said central span portion and engaging said barrier member at a location wherein said barrier element has a second thickness, said second thickness being greater than said first thickness.

7. The compressor assembly of claim 6 wherein said compressor mechanism comprises mutually engaged first and second scroll members, each of said scroll members having a base plate and a spiral wrap extending therefrom, said barrier element being defined by one of said base plates.

8. The compressor assembly of claim 6 wherein said valve member has a length and a width, said length being substantially greater than said width, said width of said valve member being greater than a corresponding dimension of said outlet opening, said valve member having a lengthwise axis wherein said clamping member engages said valve member proximate a first axial end of said valve member, said valve member sealingly engageable with said outlet opening proximate a second axial end of said valve member; said recess including sidewalls limiting movement of said valve member perpendicular to said lengthwise axis wherein said valve member remains sealingly engageable with said outlet opening when said valve member is displaced perpendicular to said lengthwise axis and engaged with one of said sidewalls.

9. A scroll compressor comprising:

a first scroll member having a first base plate with a front face and an opposite rear face and a first spiral wrap extending from said front face of said first base plate;

a second scroll member having a second base plate and a second spiral wrap extending from said second base plate; said first and second scroll members positioned with said first and second wraps in mutual engagement, said first and second scroll members relatively moveably engaged wherein relative movement of said scroll members compresses a gas in a working space defined by and disposed between said first and second scroll members;

a discharge chamber disposed within said compressor;

a discharge passage extending through said first base plate at a first location wherein said first base plate has a first thickness, said discharge passage having an inlet opening in said front face in gaseous communication with said working space and an outlet opening in said rear face in gaseous communication with said discharge chamber;

a recess defined by said rear face of said first base plate, said outlet opening disposed within said recess;

a substantially planar flexible valve member disposed within said recess and sealingly engageable with said outlet opening;

a fastener; and a clamping member disposed within said recess and having first and second bearing surfaces and a central span portion disposed therebetween, said first bearing surface engaged with said rear face and said second bearing surface securing said flexible valve member against said rear face, said central span portion spaced from said rear face, said central span portion of said clamping member attached to said first base plate via said fastener at a second location wherein said first base plate has a second thickness greater than said first thickness.

10. The compressor of claim 9 wherein said clamping member is a substantially C-shaped member attached to said first base plate by said fastener extending through an aperture in said central span portion and engaging said first base plate at said second location.

11. The compressor of claim 9 further comprising a valve retaining member disposed adjacent said valve member and limiting movement of said valve member away from said outlet opening.

12. The compressor of claim 9 wherein said valve member has a length and a width, said length being substantially greater than said width, said width of said valve member being greater than a corresponding dimension of said outlet opening, said valve member having a lengthwise axis wherein said clamping member engages said valve member proximate a first axial end of said valve member, said valve member sealingly engageable with said outlet opening proximate a second axial end of said valve member; said recess including sidewalls limiting movement of said valve member perpendicular to said lengthwise axis wherein said valve member remains sealingly engageable with said outlet opening when said valve member is displaced perpendicular to said lengthwise axis and engaged with one of said sidewalls.

13. The compressor of claim 9 wherein said outlet opening has a generally circular configuration and said valve member has a width and a length wherein said length is substantially greater than said width, said width of said valve member at said outlet opening being greater than said diameter of said outlet opening.

14. The compressor of claim 9 wherein said valve member includes an opening and said clamp includes a recess having an integral projection therein, said valve member being partially disposed within said recess and said projection being disposed within said opening.

15. The compressor of claim 9 wherein said clamp includes a recess and said valve member is partially disposed within said recess.

16. The compressor of claim 15 further comprising a retaining member disposed adjacent said valve member and limiting movement of said valve member away from said outlet opening, said retaining member partially disposed within said recess.

17. The compressor of claim 16 wherein said clamp directly engages said retaining member and said retaining member is directly engaged with said valve member.

* * * * *

UNITED STATES PATENT AND TRADEMARK OFFICE

CERTIFICATE OF CORRECTION

PATENT NO. : 7,018,183 B2
APPLICATION NO. : 10/657637
DATED : March 28, 2006
INVENTOR(S) : David K. Haller et al.

It is certified that error appears in the above-identified patent and that said Letters Patent is hereby corrected as shown below:

Claim 1, Column 12, Line 50, after "within" insert --said--.

Signed and Sealed this

Fourth Day of July, 2006

JON W. DUDAS
*Director of the United States Patent and Trademark Office*